US011004628B2

(12) United States Patent
Izawa et al.

(10) Patent No.: US 11,004,628 B2
(45) Date of Patent: May 11, 2021

(54) KEY SWITCH DEVICE

(71) Applicant: Omron Corporation, Kyoto (JP)

(72) Inventors: Kazuhira Izawa, Okayama (JP); Mamiko Naka, Okayama (JP); Kenshi Nagata, Kurayoshi (JP); Shigenobu Kishi, Ritto (JP)

(73) Assignee: Omron Corporation, Kyoto (JP)

( * ) Notice: Subject to any disclaimer, the term of this patent is extended or adjusted under 35 U.S.C. 154(b) by 34 days.

(21) Appl. No.: 16/482,906

(22) PCT Filed: Dec. 14, 2017

(86) PCT No.: PCT/JP2017/044907

§ 371 (c)(1),
(2) Date: Aug. 1, 2019

(87) PCT Pub. No.: WO2018/168135

PCT Pub. Date: Sep. 20, 2018

(65) Prior Publication Data

US 2020/0243279 A1 Jul. 30, 2020

(30) Foreign Application Priority Data

Mar. 15, 2017 (JP) ..... JP2017-050206

(51) Int. Cl.
*H01H 13/83* (2006.01)
*H01H 13/705* (2006.01)
*H01H 13/78* (2006.01)

(52) U.S. Cl.
CPC ..... *H01H 13/83* (2013.01); *H01H 13/705* (2013.01); *H01H 13/78* (2013.01); *H01H 2219/062* (2013.01); *H01H 2235/01* (2013.01)

(58) Field of Classification Search
CPC ..... H01H 13/83; H01H 13/705; H01H 13/78; H01H 2219/062; H01H 2235/01
(Continued)

(56) References Cited

U.S. PATENT DOCUMENTS 7,514,643 B1 4/2009 Tittle
9,305,721 B2 * 4/2016 Izawa ..... H01H 13/20
(Continued)

FOREIGN PATENT DOCUMENTS

CN 104851727 A 8/2015
JP S61-76633 U 5/1986
(Continued)

OTHER PUBLICATIONS

International Search Report for corresponding International Application No. PCT/JP2017/044907, dated Feb. 27, 2018 (6 pages).
(Continued)

*Primary Examiner* — Edwin A. Leon
(74) *Attorney, Agent, or Firm* — Osha Bergman Watanabe & Burton LLP

(57) ABSTRACT

A key switch device includes a base including an opening in a central part thereof; a light guide including an elastic body receiving portion, the light guide being supported by the base to be disposed in the opening; a button attached capable of approaching and separating from the base to cover the light guide; an elastic body disposed between the elastic body receiving portion and a lower surface of the button, the elastic body biasing the button in a separating direction where the button is separated from the base; a fixed contact piece including a fixed contact, the fixed contact piece being attached to the base; and a movable contact piece, which is attached to the base, including a movable contact to be brought into contact with the fixed contact when the button is moved toward the base in an approaching direction where the button approaches the base.

18 Claims, 12 Drawing Sheets

(58) Field of Classification Search
USPC ..... 200/314
See application file for complete search history.

(56) References Cited

U.S. PATENT DOCUMENTS

| | | | | |
|---|---|---|---|---|
| 9,362,066 | B2 * | 6/2016 | Izawa | H01H 13/20 |
| 10,714,282 | B2 * | 7/2020 | Izawa | H01H 11/00 |
| 2006/0000699 | A1 | 1/2006 | Sasaki et al. | |
| 2014/0251778 | A1 | 9/2014 | Izawa | |
| 2015/0043192 | A1 | 2/2015 | Tanoue et al. | |
| 2017/0011871 | A1 | 1/2017 | Izawa et al. | |

FOREIGN PATENT DOCUMENTS

| | | | |
|---|---|---|---|
| JP | 2006-019131 | A | 1/2006 |
| JP | 2008-59267 | A | 3/2008 |
| JP | 2014-175180 | A | 9/2014 |
| JP | 2015-35396 | A | 2/2015 |
| JP | 2015-149249 | A | 8/2015 |

OTHER PUBLICATIONS

Written Opinion for corresponding International Application No. PCT/JP2017/044907, dated Feb. 27, 2018 (8 pages).

* cited by examiner

KEY SWITCH DEVICE

TECHNICAL FIELD

The present disclosure relates mainly to a key switch device used for a keyboard.

BACKGROUND ART

Conventionally, a known key switch device is, for example, a keyboard switch in which a cylindrical guide post is protruded from a base, a light guide is guided on the inner diameter side of the guide post, and a coil spring disposed on the outer diameter side elastically supports a button so that the button can be pressed in (see PTL 1, for example).

CITATION LIST

Patent Literature

PTL 1: Chinese Patent Application Publication No. 104851727

SUMMARY OF INVENTION

Technical Problem

However, in a conventional key switch device, a guide post is required, and the occupied area in plan view becomes larger accordingly. Moreover, the light guide protrudes from an upper surface of the base, and the height dimension is large.

An object of the present disclosure is to provide a key switch device capable of realizing a reduction in height while reducing the occupied space in plan view.

Solution to Problem

As means for solving the above problems, the present disclosure provides a key switch device comprising:

a base including an opening in a central part thereof;

a light guide including an elastic body receiving portion, the light guide being supported by the base to be disposed in the opening;

a button attached capable of approaching and separating from the base to cover the light guide;

an elastic body disposed between the elastic body receiving portion and a lower surface of the button, the elastic body biasing the button in a separating direction where the button is separated from the base;

a fixed contact piece including a fixed contact, the fixed contact piece being attached to the base; and a movable contact piece, which is attached to the base, including a movable contact to be brought into contact with the fixed contact when the button is moved toward the base in an approaching direction where the button approaches the base.

Advantageous Effects of Invention

With the present disclosure in which the light guide is disposed in the opening of the base and the elastic body is directly pressed against the elastic body receiving portion of the light guide, it is possible to realize a reduction in height while reducing the occupied area of the key switch device in plan view.

DESCRIPTION OF EMBODIMENTS

The following description will describe embodiments according to the present disclosure with reference to the accompanying drawings. Although terms that indicate specific directions or positions (e.g., terms including "upper", "lower", "side", and "end") are used as needed in the following description, it is to be noted that the use of those terms is for facilitating the understanding of the disclosure with reference to the drawings, and the technical scope of the present disclosure is not limited by the meanings of the terms. Moreover, the following description is merely illustrative in nature, and is not intended to limit the present disclosure, the application thereof, or the use thereof. Furthermore, the drawings are schematic, and the ratio of each dimension or the like is different from the actual one.

Figure 1:
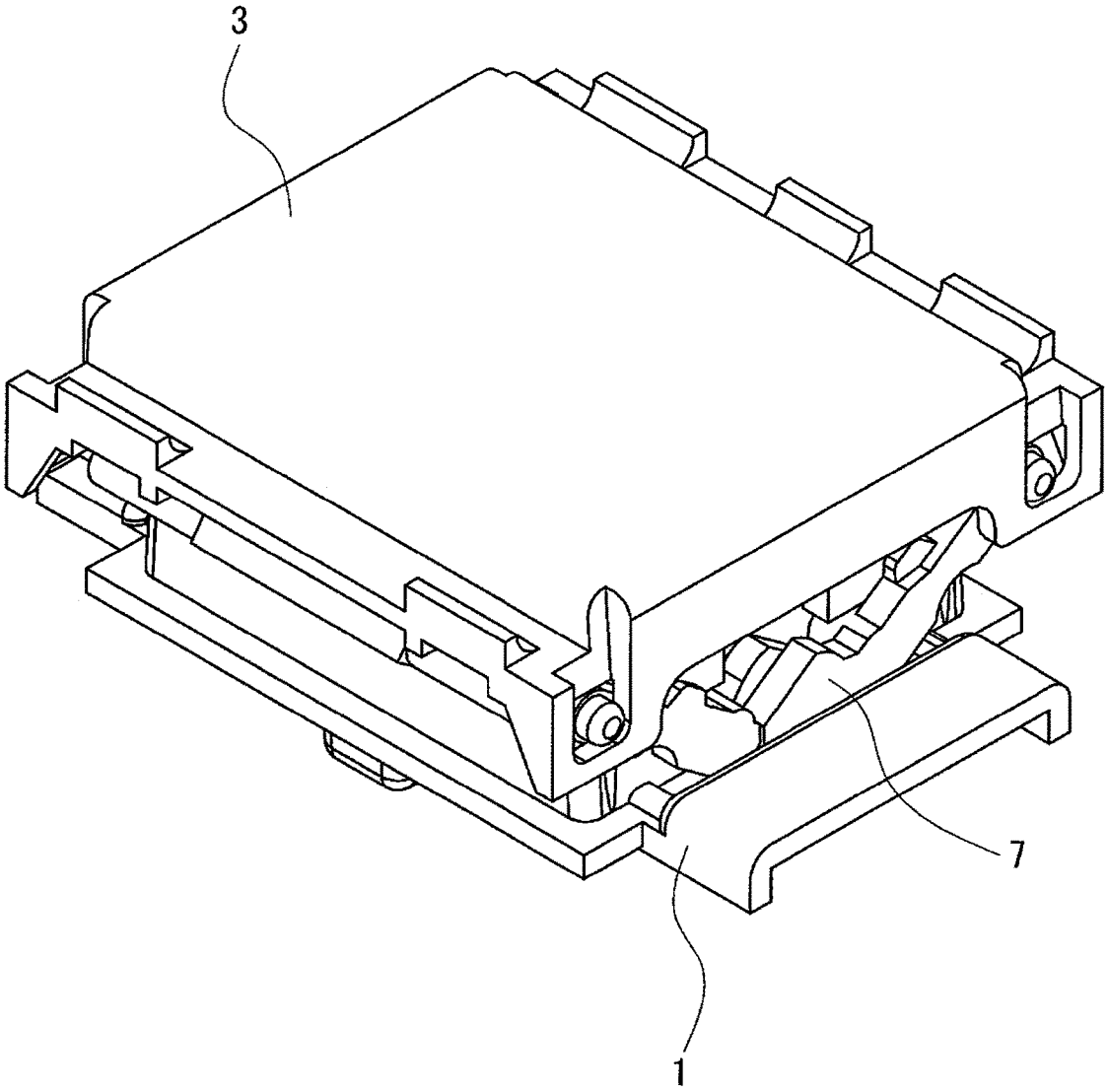
FIG. 1 is a perspective view of a key switch device according to the present embodiment.
Figure 2:
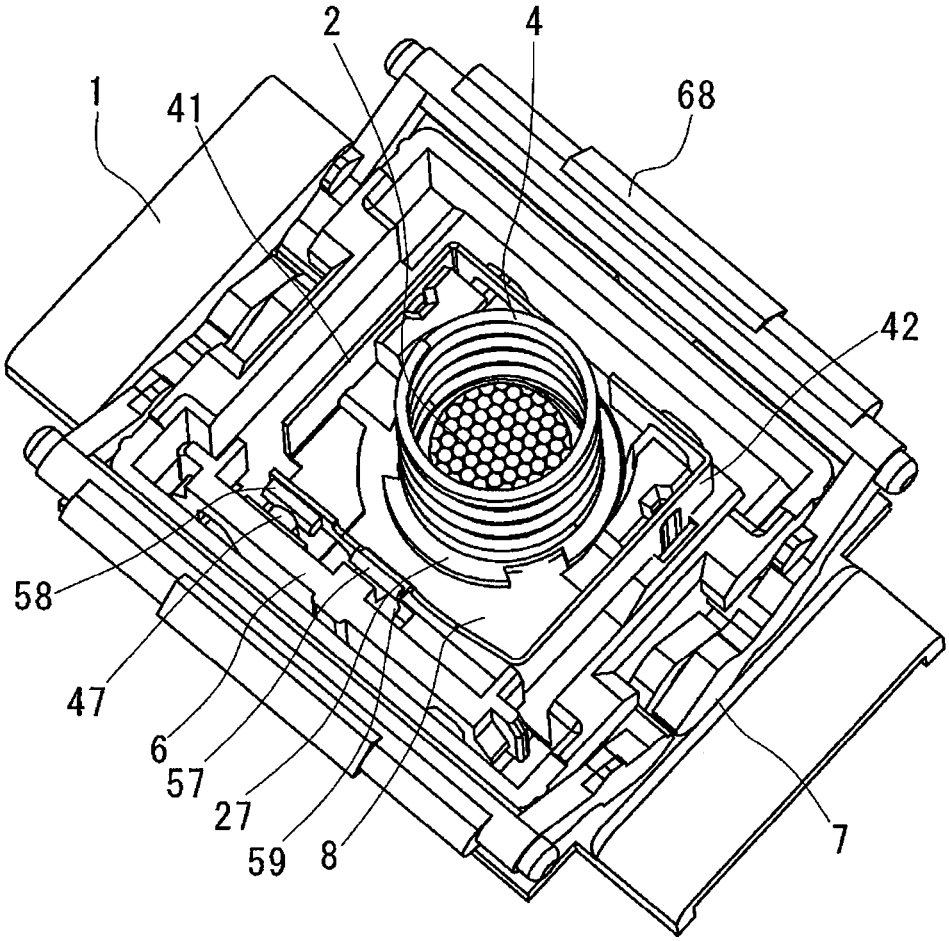
FIG. 2 is a perspective view illustrating a state where a button is removed from FIG. 1.
Figure 3:
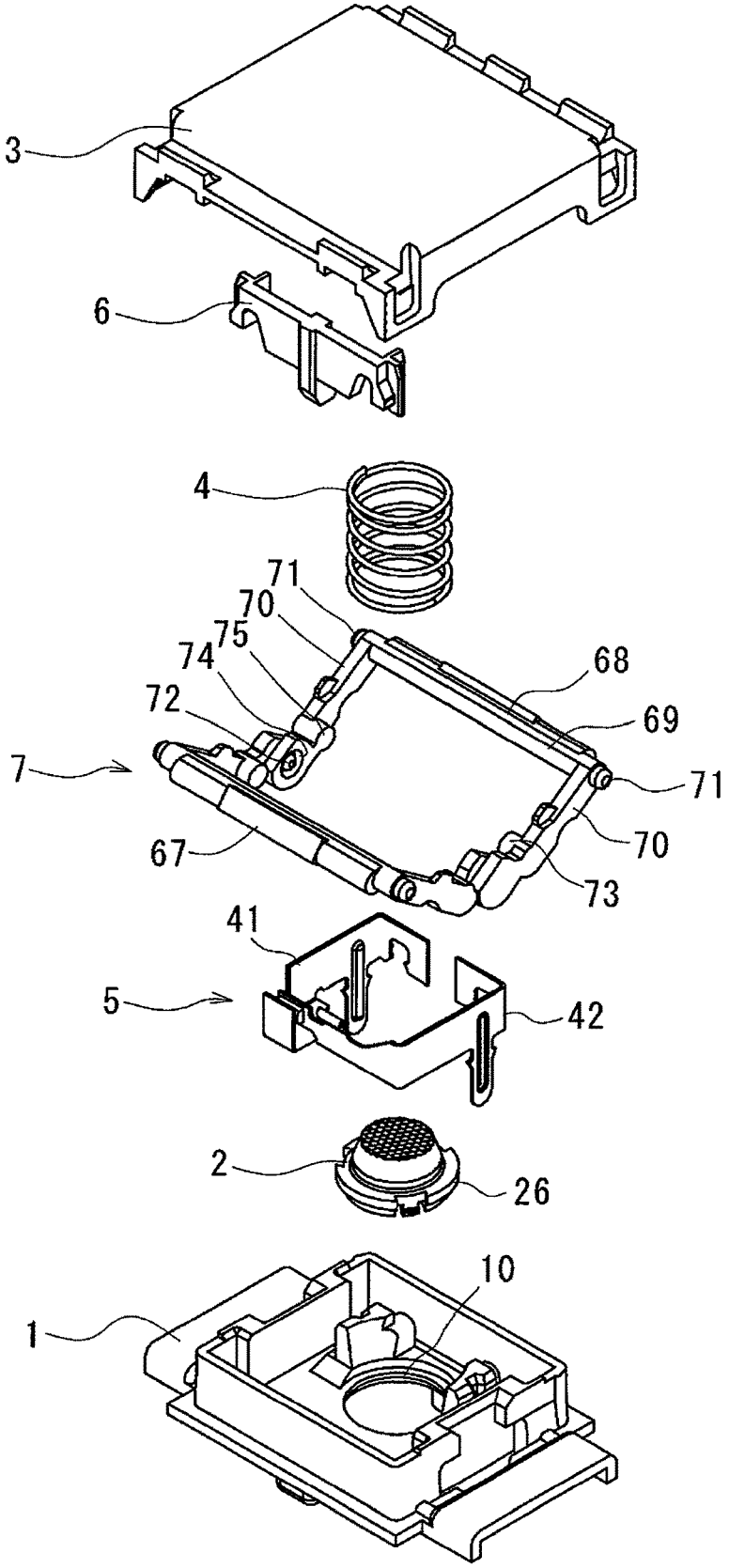
FIG. 3 is an exploded perspective view of the key switch device illustrated in FIG. 1.

FIG. 1 is a perspective view illustrating the entire key switch device according to the present embodiment. FIG. 2 is a perspective view illustrating a state where a button 3 is removed from FIG. 1. FIG. 3 is an exploded perspective view of the key switch device in FIG. 1. The key switch device includes a base 1, a light guide 2, a button 3, a coil spring 4, a contact opening/closing mechanism 5, a slider 6, and an elevation mechanism 7.

Figure 4A:
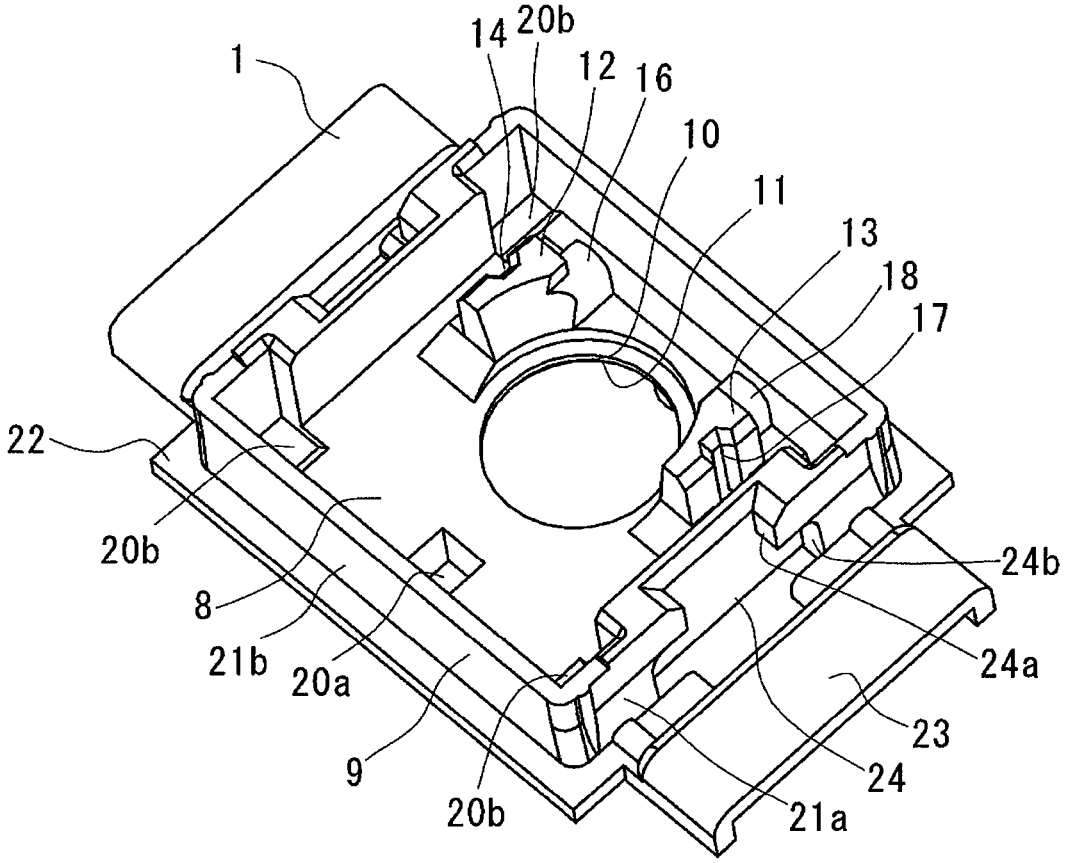
FIG. 4A is a perspective view of the base in FIG. 3.
Figure 4B:
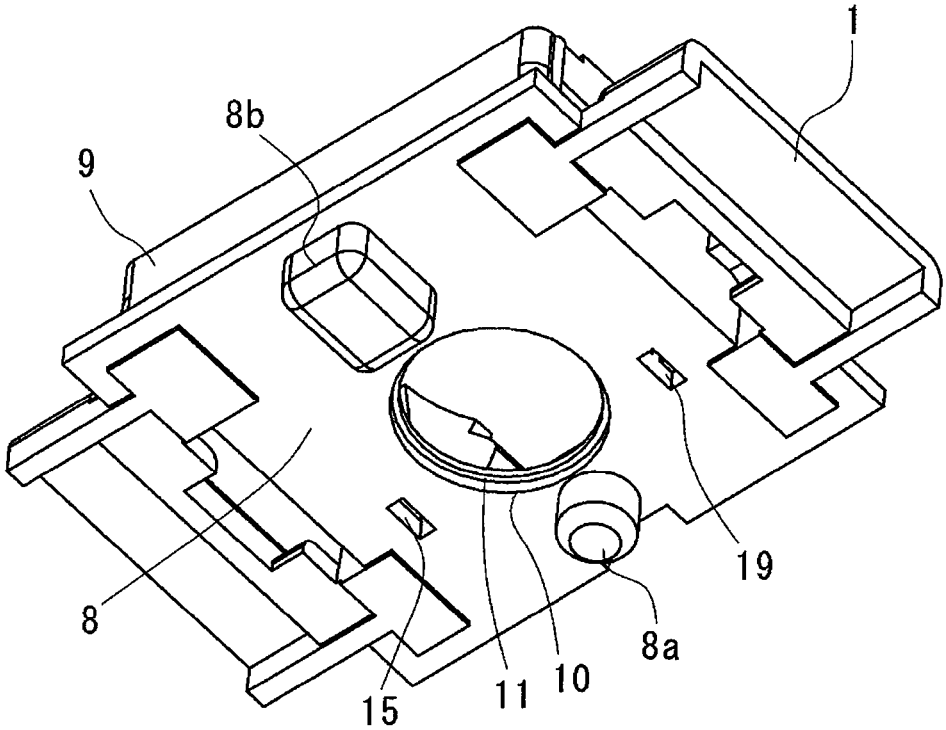
FIG. 4B is a perspective view of FIG. 4A viewed from below.

As illustrated in FIGS. 4A and 4B, the base 1, which is composed of, for example, a synthetic resin material, includes a bottom portion 8 and a rectangular frame portion 9.

The bottom portion 8 includes an opening 10 having a circular shape in plan view. On an inner peripheral surface of the opening 10, an annular lock receiving portion 11 is formed in a central part of the inner peripheral surface of the opening 10 in an up-and-down direction. Locking claws 29*a* of the light guide 2 are locked to the lock receiving portion 11 as will be described later.

In the vicinity of the opening 10, a first mount 12 and a second mount 13 are formed. A first locking groove 14 extending in the up-and-down direction is formed in a side surface of the first mount 12. A first terminal hole 15 that is continuous with the first locking groove 14 and communicates with a lower surface thereof is formed at the bottom portion 8. The first mount 12 includes a first locking ridge 16 having an upper surface configured as a convex arc surface. The second mount 13 has a structure similar to that of the first mount 12. The second mount 13 includes a second locking groove 17 and a second locking ridge 18. A second terminal hole 19 that communicates with the second locking groove 17 is formed at the bottom portion 8. A fixed contact piece 41 is fixed to the first mount 12, and a movable contact piece 42 is fixed to the second mount 13. A depression 20*a* having a rectangular shape in plan view is formed in a central portion of an upper surface of one side portion of the bottom portion 8. A depression 20*b* is formed at each of the four corners of the bottom portion 8. When the button 3 is pressed down, the lower end of an abutting portion 36 of the button 3 that will be described later abuts on the bottom surface of the depression 20*b*, so that the further movement of the button 3 in a direction orthogonal to the bottom portion 8 is restricted.

The rectangular frame portion 9 includes two pairs of opposing side walls 21*a* and 21*b*. A flange portion 22 is formed on the outer side of the side walls 21*a* and 21*b*. The flange portion 22 is used to support the elevation mechanism 7 that will be described later. An extrusion prevention wall 23 is formed on the outer side of the flange portion 22 on the outer side of the opposing side walls 21*a*. The extrusion prevention wall 23 prevents a first arm 67 and a second arm 68 from being extruded laterally. A recessed part 24 is formed in a central portion of the outer surface of each of the opposing side walls 21*a*. Each recessed part 24 includes a narrow groove 24*a* and a relief recess 24*b* which is wider than the groove 24*a*. The narrow groove 24*a* constitutes an upper half of a side wall 21*a* and the relief recess 24*b* constituted of a lower half of a side wall 21*a*. The width dimension of the groove 24*a* is set such that the first arm 67 and the second arm 68 that will be described later can be inserted in a folded state.

Figure 5A:
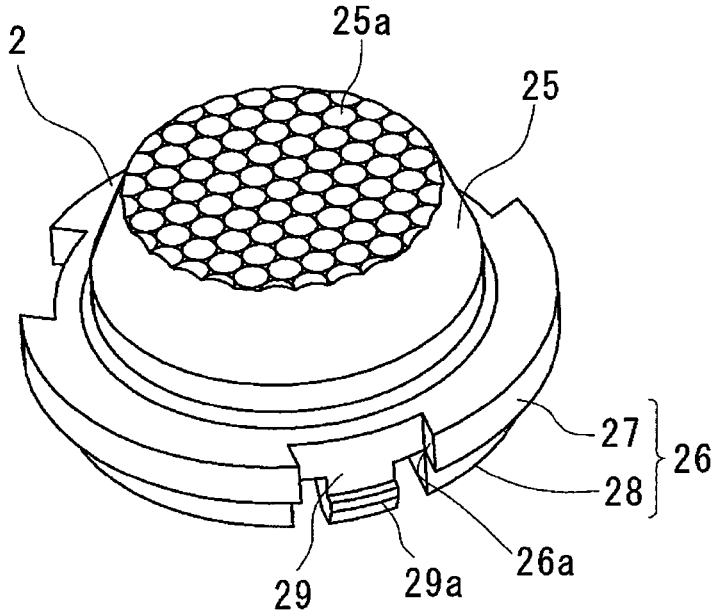
FIG. 5A is a perspective view of the light guide in FIG. 3 viewed from above.
Figure 5B:
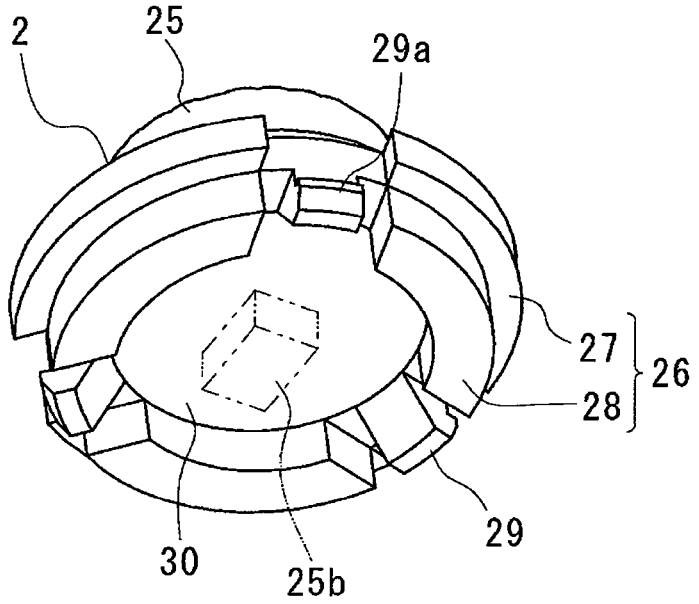
FIG. 5B is a perspective view of the light guide in FIG. 5A viewed from below.

As illustrated in FIGS. 5A and 5B, the light guide 2, which is formed by molding a translucent synthetic resin material, includes a light guide main body 25 having a truncated cone shape, and an elastic body receiving portion 26 that protrudes in the radial direction from a lower end portion of the light guide main body 25.

A plurality of convex lenses 25*a* are formed on the top surface of the light guide main body 25. The convex lenses 25*a* diffuse light from an LED (Light Emitting Diode) 25*b* (see FIG. 5B), which is a light source.

The elastic body receiving portion 26, which has a flange-like shape, includes a receiving portion main body 27 of the upper half portion (i.e., a portion close to the light guide main body 25), and a cylindrical body 28 of the lower half portion (i.e., a portion far from the light guide main body 25). Notches 26*a* are formed at three positions at equal intervals in the circumferential direction in the elastic body receiving portion 26, and claw portions 29 are respectively formed there. The receiving portion main body 27 and the cylindrical body 28 are divided into three arc-shaped parts by the notches 26*a*. The receiving portion main body 27 has an outer diameter larger than the opening 10 of the base 1. A lower surface of the receiving portion main body 27 abuts on the upper surface of the bottom portion 8. The outer surface of the cylindrical body 28 abuts on the inner surface of the opening 10 to position the light guide 2 in the radial direction with respect to the base 1. A LED 25*b* is disposed in a recess 30 surrounded by the lower surface of the receiving portion main body 27 and the inner surface of the cylindrical body 28. Each claw portion 29 extends downward as with the cylindrical body 28. A locking claw 29*a* protruding to the outer diameter side is formed in a tip part of each claw portion 29. Each locking claws 29*a* is locked to the lock receiving portion 11 formed in the opening 10 of the base 1 and prevents the light guide 2 from coming off the opening 10 upward.

Figure 6A:
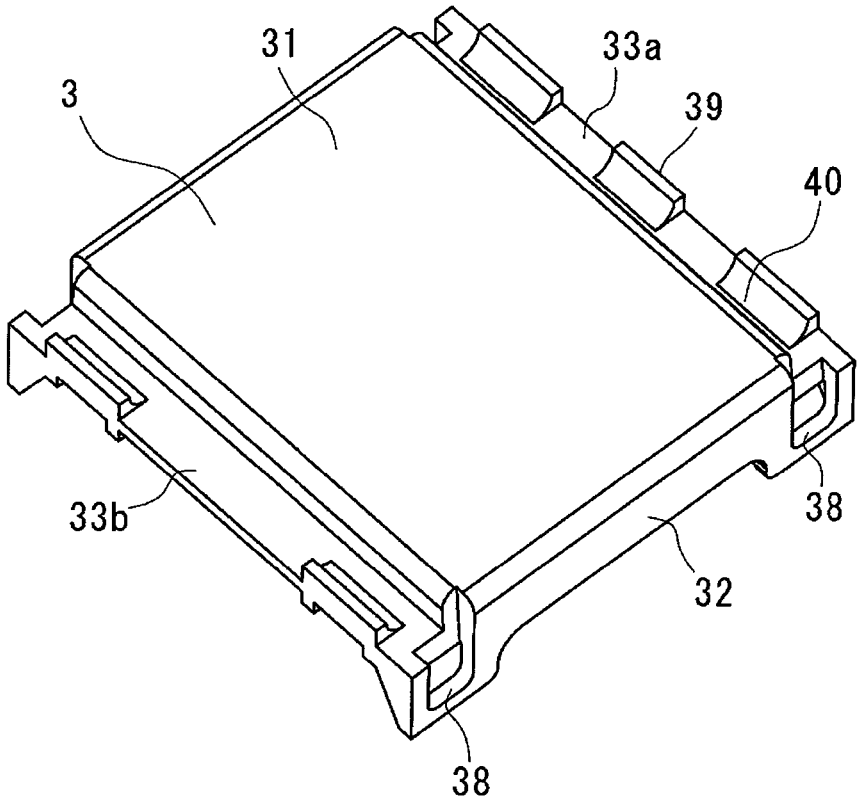
FIG. 6A is a perspective view of the button in FIG. 3 viewed from above.
Figure 6B:
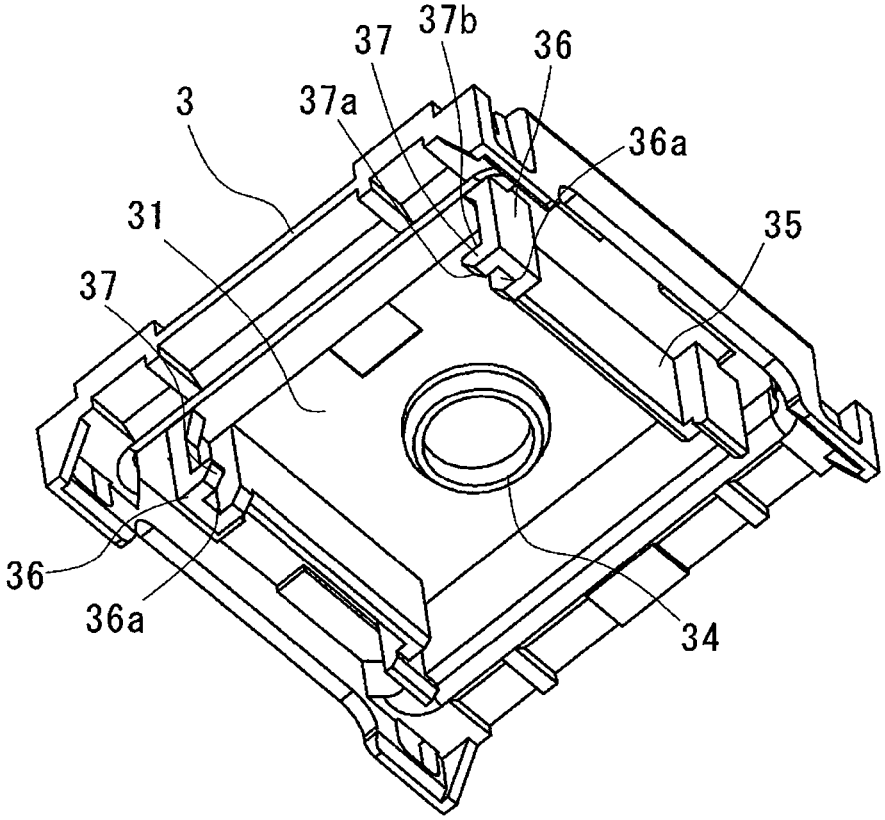
FIG. 6B is a perspective view of the button in FIG. 6B viewed from below.

As illustrated in FIGS. 6A and 6B, the button 3, which is composed of, for example, a synthetic resin material, has a rectangular shape in plan view. The button 3 includes a flat plate portion 31, side wall portions 32 respectively extending downward from two opposing sides of the flat plate portion 31, and extending portions 33*a* and 33*b* respectively extending laterally from the remaining two sides of the flat plate portion 31.

A cylindrical spring guide portion 34 is formed in a central portion of a lower surface (i.e., a surface facing the base 1) of the flat plate portion 31. A guide wall 35 is provided on the lower surface of the flat plate portion 31 along three sides. On the opposing walls on both sides of the guide wall 35, abutting portions 36 protruding more than the other part are formed at both end parts. The opposing walls protrude inward except at both end portions. Guide grooves 36*a* configured to guide the slider 6 are respectively formed in the opposing parts of the abutting portions 36 located at both ends of the guide wall 35. One of sidewalls constituting each guide groove 36*a* is cut except for upper and lower end portions. A lifting protrusion 37 is formed in a lower end portion of the one of the sidewalls. Each lifting protrusion 37 includes a lower inclined surface 37*a* that gradually inclines upward, and an upper flat surface 37*b*.

Bearing holes 38 are formed at both end parts extending further downward of each sidewall portion 32. In each bearing hole 38, the first arm 67 and a first shaft portion 71 of the second arm 68 that will be described later are rotatably and slidably supported.

A projection 39 having a concave circular arc surface is formed at three positions in one extending portion 33*a*. A side edge of the flat plate portion 31 and an arc surface of the projection 39 constitute a support portion 40 configured to support an unillustrated balance bar.

Returning to FIG. 3, the coil spring 4 is disposed between the elastic body receiving portion 26 of the light guide 2 and the spring guide portion 34 of the button 3. The coil spring 4 biases the button 3 upward (i.e., a direction orthogonal to the bottom portion 8 of the base 1 and away from the base 1) with respect to the base 1.

The contact opening/closing mechanism 5 includes a fixed contact piece 41 and the movable contact piece 42, which are formed by pressing and bending flat-plate copper alloy.

Figure 7A:
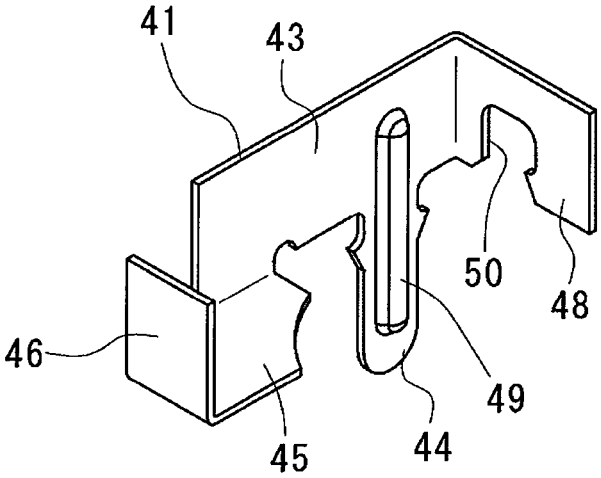
FIG. 7A is a perspective view of the fixed contact piece in FIG. 3.
Figure 7B:
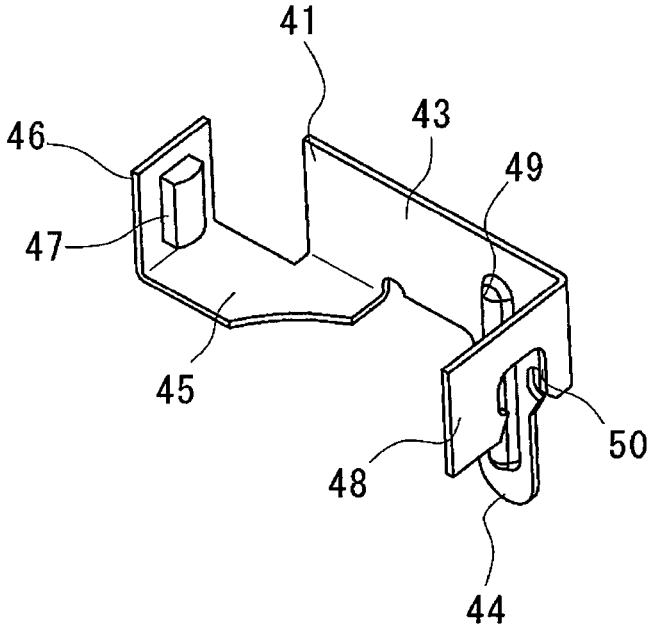
FIG. 7B is a perspective view of the fixed contact piece in FIG. 7A viewed from a different angle.

As illustrated in FIGS. 7A and 7B, the fixed contact piece 41 comprises: a first flat surface portion 43; a fixed terminal portion 44 extending downward from a central portion of a lower edge of the first flat surface portion 43; a second flat surface portion 45 extending orthogonally from one end side of a lower edge of the first flat surface portion 43; a third flat surface portion 46 extending orthogonally from one end edge of the second flat surface portion 45; a fixed contact 47 provided on the third flat surface portion 46; and a fourth flat surface portion 48 extending orthogonally from the other end edge of the flat surface portion 43 and opposed to the third flat surface portion 46. A first locking protrusion 49 extended to the first flat surface portion 43 is formed in a central part of the fixed terminal portion 44. The first locking protrusion 49 is locked to the first locking groove 14 formed in the first mount 12 of the base 1. The fixed terminal portion 44 is press-fitted into the first terminal hole 15 and protrudes from a lower surface of the bottom portion 8. A first locking recess 50 cut in a circular arc shape is formed in a central portion of a lower edge of the fourth flat surface portion 48. The first locking recess 50 is locked to the first locking ridge 16 of the first mount 12.

Figure 8A:
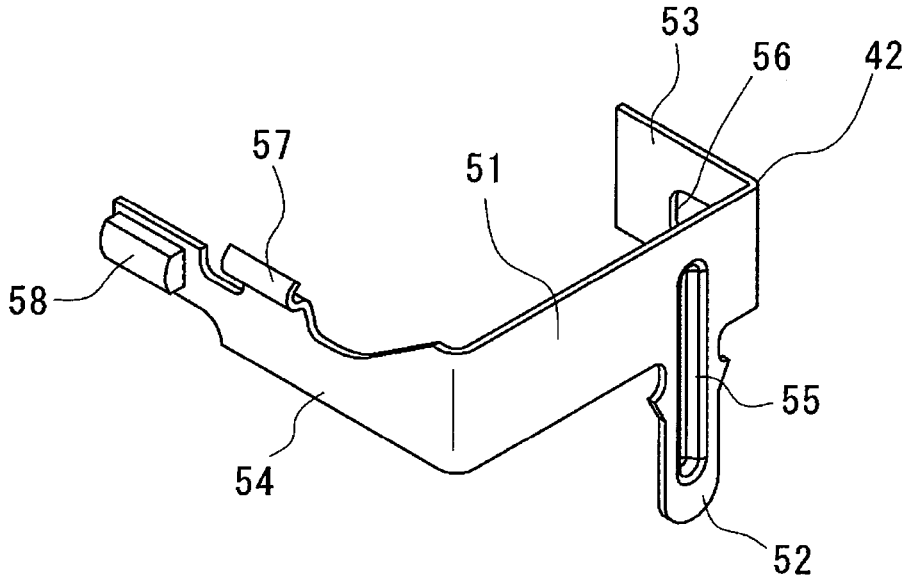
FIG. 8A is a perspective view of the movable contact piece in FIG. 3.
Figure 8B:
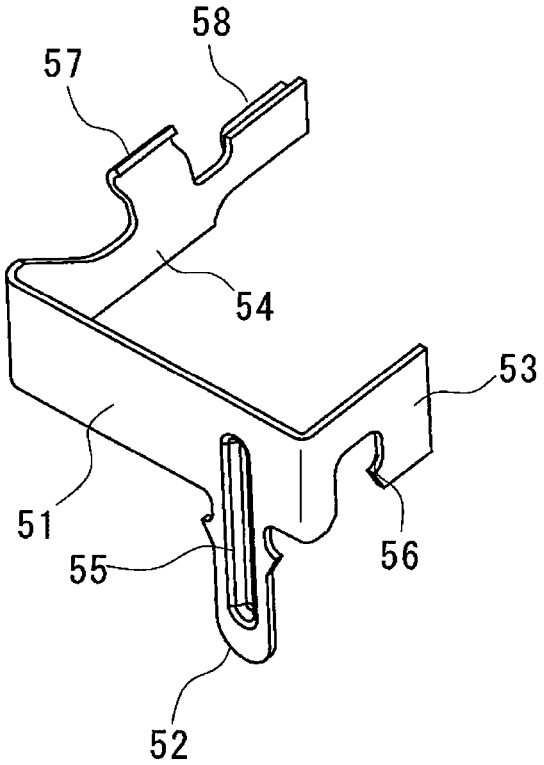
FIG. 8B is a perspective view of the movable contact piece in FIG. 8A viewed from a different angle.

As illustrated in FIGS. 8A and 8B, the movable contact piece 42 comprises: a first flat surface portion 51; a movable terminal portion 52 extending downward from one end side of a lower edge of the first flat surface portion 51; a second flat surface portion 53 extending orthogonally from one end of the first flat surface portion 51; and a third flat surface portion 54 extending orthogonally from the other end of the first flat surface portion 51 and partially opposed to the second flat surface portion 53. A second locking protrusion 55 extended to the first flat surface portion 51 is formed in a central part of the movable terminal portion 52. A second locking recess 56 cut in a circular arc shape is formed in a canral portion of a lower edge of the second flat surface portion 53. The second locking recess 56 is locked to the second locking ridge 18 of the first mount 12. A protruding piece 57 (an example of a press receiving portion) bent in a substantially C-shaped cross section is formed in a central portion of an upper edge of the third flat surface portion 54. The protruding piece 57 is pressed by a pressing portion 59 of the slider 6 that will be described later, and elastically deforms the third flat surface portion 54 (and further, the first flat surface portion 51). A movable contact 58 is provided on the tip outer surface of the third flat surface portion 54.

Figure 9A:
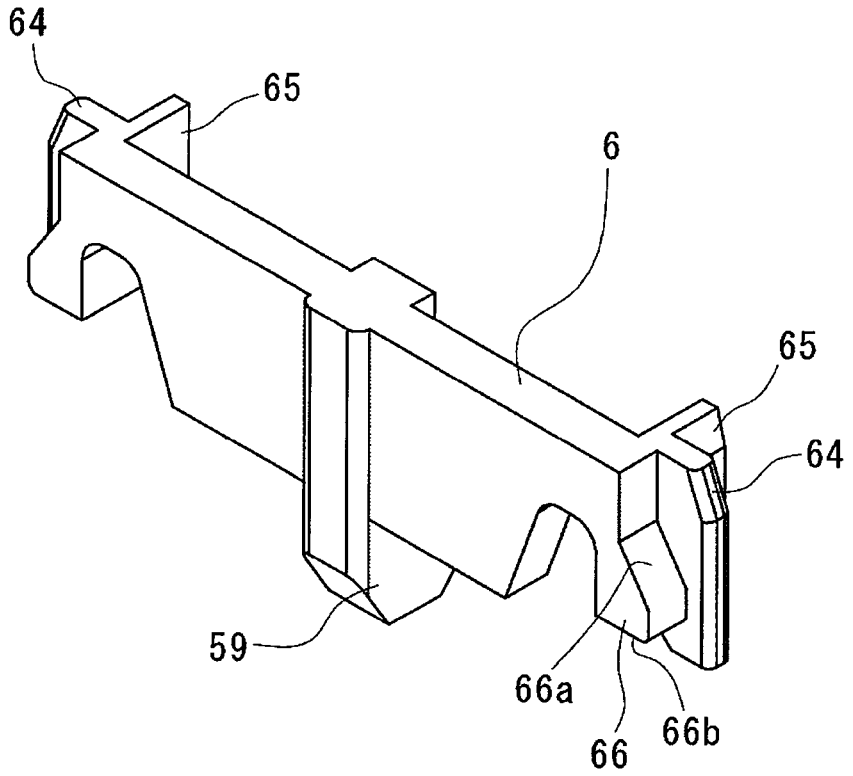
FIG. 9A is a perspective view of the slider in FIG. 3.
Figure 9B:
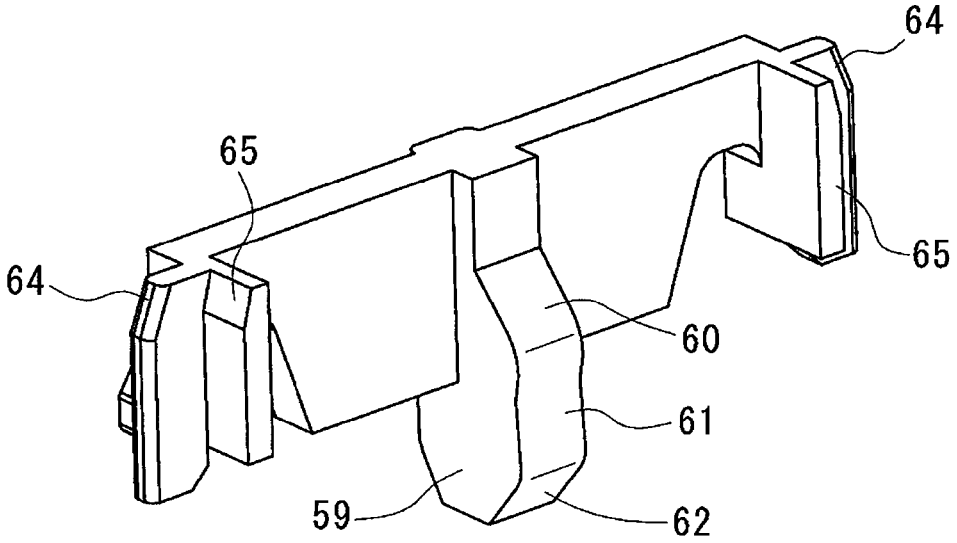
FIG. 9B is a perspective view of the slider in FIG. 9A viewed from a different angle.

As illustrated in FIGS. 9A and 9B, the slider 6 is composed of, for example, a synthetic resin material and has a flat plate shape. The slider 6 includes the pressing portion 59 in a central part thereof. The pressing portion includes a first inclined surface 60 that gradually protrudes from a lower side by a predetermined dimension from the upper end, and a concave surface 61 that is continuous with the first inclined surface 60 and in which the center of the protruding part is slightly depressed. The pressing portion 59 further includes a second inclined surface 62 in which the protruding dimension gradually becomes smaller on the lower end side of the protruding part.

Moreover, the slider 6 includes guided protrusions 64 in both ends. Each guided protrusion 64 is formed to divide a central portion of the outer surface of the flat portion 65 provided at both end portions of the slider 6 into two left and right parts. A guided protrusion 64 is inserted into a guide groove 36 formed in the button 3 and is guided to move up and down. A lifted protrusion 66 is formed on one lower side of the two parts divided by the guided protrusion 64 of the flat portion 65. An upper surface of the lifted protrusion 66 is an inclined surface 66*a* that protrudes gradually downward, and a lower surface is a flat surface 66*b*. The flat surface 37*b* of the lifting protrusion 37 abuts on the flat surface 66*b* of the lifted protrusion 66, and is lifted together when the button 3 moves upward.

Returning to FIG. 3, the elevation mechanism 7 includes the first arm 67 and the second arm 68. The first arm 67 and the second arm 68 have substantially the same shape, and each have a shaft 69, and arm portions 70 extending from both end portions thereof. The first shaft portions 71 are respectively formed at both end portions of the shaft 69. A second shaft portion 72 protruding inward and a first projection 73 are formed on the tip side of one arm portion 70. A bearing pore 74 through which the second shaft portion 72 is rotatably inserted, and a second projection 75 protruding inward are formed on the tip end side of the other arm portion 70.

The first arm 67 and the second arm 68 are coupled with each other by inserting the second shaft portion 72 of the first arm 67 into the bearing pore 74 of the second arm 68 and inserting the second shaft portion 72 of the second arm 68 into the bearing pore 74 of the first arm 67. Regarding the first arm 67 and the second arm 68 coupled with each other, the coupled part is inserted into the groove 24*a* of the base 1 in a folded state and is spread at the relief recess 24*b*, so that the first projection 73 and the second projection 75 abut on an upper surface constituting the relief recess 24*b*, and coming off the base 1 is prevented. The first arm 67 and the second arm 68 coupled with each other are coupled with the button 3 by inserting the first shaft portions 71 into the bearing holes 38 of the button 3. Movement of the button 3 in the protruding direction is restricted by abutting of the first shaft portions 71 on the inner edge of the bearing holes 38. Movement of the button 3 in the pushing direction is restricted by abutting of the lower end of the abutting portion 36 on the bottom surface of the depression 20*b* of the base 1.

Next, an assembling method of the key switch device having the above structure will be described.

The light guide 2 is disposed in the opening 10 of the base 1. The cylindrical body 28 of the light guide 2 is inserted into the opening 10, so that the flange portion 22 abuts on the upper surface of the bottom portion 8 of the base 1. As a result, the locking claws 29*a* of the claw portions 29 are locked to the lock receiving portion 11 of the opening 10, and the light guide 2 is attached to the base 1.

The coil spring 4 is disposed around the light guide 2 disposed in the opening 10 of the base 1. In such a state, the lower end portion of the coil spring 4 abuts on the elastic body receiving portion 26 of the light guide 2.

The fixed contact piece 41 is attached to the first mount 12 of the base 1, and the movable contact piece 42 is attached to the second mount 13. The fixed contact piece 41 is fixed to the base 1 by press-fitting the fixed terminal portion 44 into the first terminal hole 15 of the base 1, locking the first locking protrusion 49 to the first locking groove 14 of the first mount 12, and locking the first locking recess 50 to the first locking ridge 16 of the first mount 12. The movable contact piece 42 is fixed to the base 1 by press-fitting the movable terminal portion 52 into the second terminal hole 19 of the base 1, locking the second locking protrusion 55 to the second locking groove 17 of the second mount 13, and locking the second locking recess 56 to the second locking ridge 18 of the second mount 13. In such a state, the movable contact 58 is opposed to the fixed contact 47 to be able to come into contact.

The first arm 67 and the second arm 68 are coupled with each other by inserting the second shaft portion 72 of the first arm 67 into the bearing pore 74 of the second arm 68 and inserting the second shaft portion 72 of the second arm 68 into the bearing pore 74 of the first arm 67. Then, the first arm 67 and the second arm 68 are inserted into the recess 30 via the groove 24*a* of the base in a folded state, and are spread into a V-shape. Furthermore, the guided protrusion 64 of the slider 6 is guided by the guide groove 36 of the button 3. In such a state, the first arm 67 and the first shaft portions 71 of the second arm 68 are inserted into the bearing holes 38 of the button 3. Thus, the button 3 is biased in the protruding direction by biasing force of the coil spring 4 disposed between the button 3 and the light guide 2. Movement of the button 3 in the protruding direction is restricted by abutting of the first arm 67 and the first shaft portions 71 of the second arm 68 on the inner edge of the bearing holes 38.

A key switch device assembled in such a manner is mounted on a printed circuit board (unillustrated) on which the LED 25*b* is mounted. In the attachment of the key switch device, the LED 25*b* is housed in the recess 30 of the light guide 2 located on a lower surface of the base 1. By adopting such a structure, the height dimension of the light guide 2 can be reduced. Accordingly, the light guide 2 can be configured not to protrude upward from the base 1. That is, the position of the upper end of the light guide 2, that is, the position of the surface of the convex lens a can be positioned below the upper end position of the rectangular frame portion 9. As a result, the height dimension of the base 1 can be reduced.

It is to be noted that an unillustrated key cap is mounted on the button 3 to be a key of a keyboard.

In a key switch device assembled in such a manner, the fixed contact piece 41 and the movable contact piece 42 are disposed in the vicinity of the periphery of the light guide 2 disposed in the opening 10 of the base 1, as illustrated in FIG. 2. The slider 6 is disposed along the third flat surface portion 46 of the movable contact piece 42. That is, necessary minimum components (i.e., the light guide 2, the coil spring 4, the fixed contact piece 41, the movable contact piece 42, and the slider 6) are disposed close to each other in a region surrounded by the rectangular frame portion 9. Accordingly, it is possible to reduce the occupied area (i.e., the size of the bottom portion 8) of the key switch device in plan view.

Figure 10:
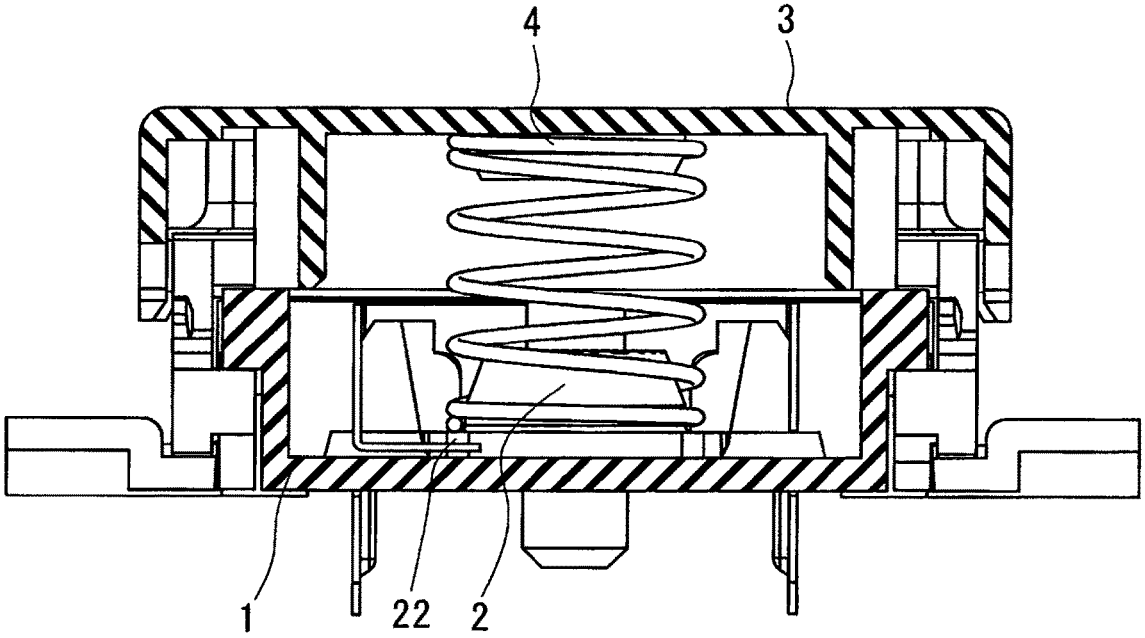
FIG. 10 is a front sectional view of the key switch device illustrated in FIG. 1.

Moreover, the base 1 is attached to the light guide 2 by disposing the cylindrical body 28 of the light guide 2 in the opening 10 of the base 1 and locking the locking claws 29*a* of the claw portions 29 to the lock receiving portion 11 of the opening 10. At this time, the LED 25*b* is housed in the recess 30 formed by the cylindrical body 28. As shown in FIG. 10, the upper end of the light guide 2 does not protrude from the upper end of the base 1. The other end of the coil spring 4 having one end being in pressure contact with the inner surface of the button 3 is directly in pressure contact with the flange portion 22 of the light guide 2. As a result, the height dimension of the key switch device can be reduced. That is, a reduction in height of the key switch device (that is, reduction in the size of the key switch device in the movable direction of the button 3) is realized.

Next, the operation of a key switch device having the above structure will be described.

Figure 11:
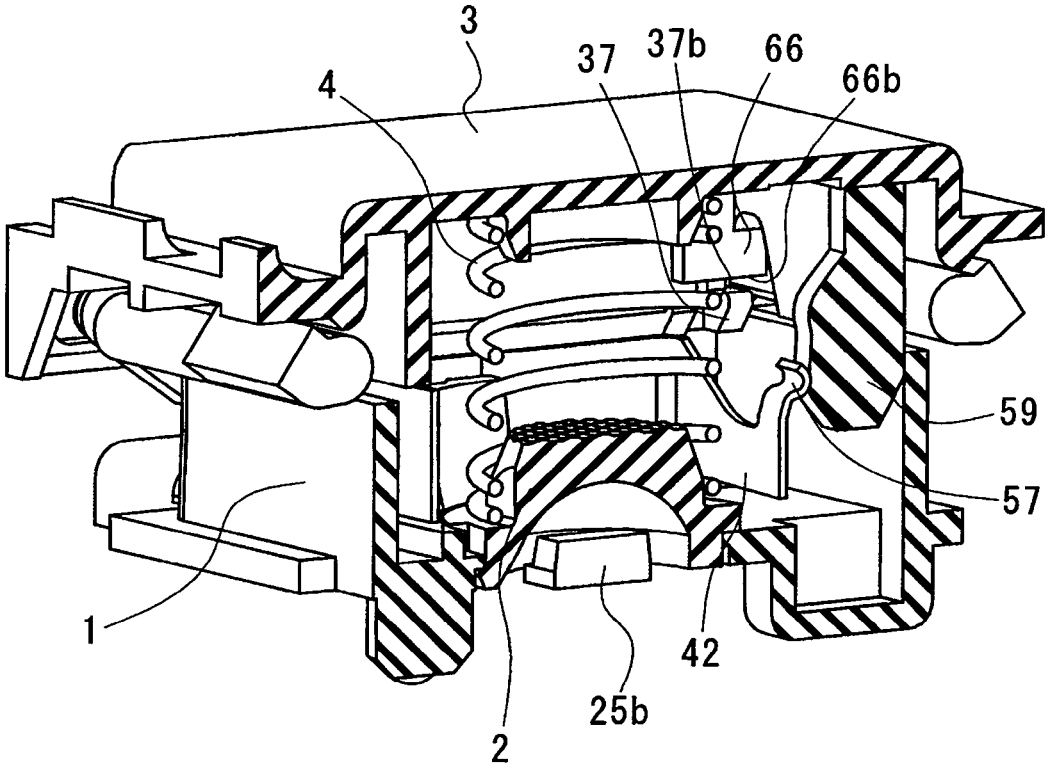
FIG. 11 is a perspective sectional view of the key switch device illustrated in FIG. 1.

In the initial state where an unillustrated key cap is not pressed, the button 3 is biased upward (that is, in an expansion/contraction direction of the coil spring 4 and away from the base 1) by biasing force of the coil spring 4, and the first shaft portions 71 of the first arm 67 and the second arm 68 abut on an inner edges of the bearing holes 38 of the second arm 68 and the first arm 67. As a result, the button 3 is positioned at the protruding position. In such a state, as illustrated in FIG. 11, the protruding piece 57 of the movable contact piece 42 is pressed by the pressing portion 59 of the slider 6, and the movable contact 58 is separated from the fixed contact 47 of the fixed contact piece 41.

When the button 3 is pressed down against the biasing force of the coil spring 4 via the key cap, the slider 6 is also moved downward (that is, in an expansion/contraction direction of the coil spring 4 and toward the base 11). At this time, the protruding piece 57 of the movable contact piece 42 changes the pressure contact position from the concave surface 61 of the slider 6 to the first inclined surface 60. As a result, elastic energy stored in the third flat surface portion 46 of the movable contact piece 42 is converted into force that biases the slider 6 downward. Consequently, the slider 6 moves downward alone with respect to the button 3, and the flat surface 66*b* of the lower end of the lifted protrusion collides with the flat surface 37*b* of the lifting protrusion 37 of the button 3 and generates sound. Since not only the slider 6 is simply dropped by its own weight but also elastic force from the movable contact piece 42 is applied, the volume of sound to be generated can be increased. In the case of a keyboard provided with a key switch device having the above structure, a user can recognize clearly that a pressing manipulation has been performed appropriately. If the keyboard is used in a game or the like, a sufficient sound suitable for the use situation can be generated by the pressing manipulation. The movable contact 58 is brought into contact with the fixed contact 47 by returning the shape of the movable contact piece 42 that has been elastically deformed so as to extend straight.

When the pressing manipulation of the button 3 is released, the biasing force of the coil spring 4 moves the button 3 upward. The first shaft portions 71 of the first arm 67 and the second arm 68 abut on the inner edge of the bearing holes 38, and the button 3 returns to the initial position. The flat surface 37*b* of the lifting protrusion 37 formed on the button 3 abuts on the flat surface 66*b* of the lifted protrusion 66 so that the slider 6 is lifted. And the pressing portion 59 presses the protruding piece 57 of the movable contact piece 42 so as to elastically deform the third flat surface portion 54 (and further, the first flat surface portion 51). As a result, the movable contact 58 is separated from the fixed contact 47 and returns to the initial state.

It is to be noted that the present disclosure is not limited to the structure described in the embodiment, and various modifications are possible.

Although the light guide 2 includes the receiving portion main body 27 and the locking claws 29*a*, and a locking structure to be locked to the lock receiving portion 11 formed in the opening 10 of the base 1 is adopted in the above embodiment, such structures are not necessarily required. An unillustrated printed circuit board on which the LED 25*b* is mounted is disposed below the light guide 2. Since the light guide 2 is held between the printed circuit board and the spring, the locking structure is not necessarily required.

Although an example of the coil spring 4 is disclosed as an elastic body in the above embodiment, the present invention is not limited to this. Another elastic component, such as sponge or rubber, can also be used.

While various embodiments of the present disclosure have been described in detail with reference to the drawings, various aspects of the present disclosure will now be described. In the following description, it is to be noted that a reference numeral will also be attached as an example.

A key switch device according to the first aspect of the present disclosure includes:

a base 1 including an opening 10 in a central part thereof;

a light guide 2 including an elastic body receiving portion 26, the light guide 2 being supported by the base 1 to be disposed in the opening 10;

a button 3 attached capable of approaching and separating from the base 1 to cover the light guide 2;

an elastic body 4 disposed between the elastic body receiving portion 26 and a lower surface of the button 3, the elastic body 4 biasing the button 3 in a separating direction where the button 3 is separated from the base 1;

a fixed contact piece 41 including a fixed contact 47, the fixed contact piece 41 being attached to the base 1; and a movable contact piece 42, which is attached to the base 1, including a movable contact 58 to be brought into contact with the fixed contact 47 when the button 3 is moved in an approaching direction where the button 3 approaches the base 1.

According to the key switch device of the first aspect, the light guide 2 is disposed in the opening 10 of the base 1 and the elastic body 4 is directly brought into pressure contact with the elastic body receiving portion 26 of the light guide 2, so that the elastic body 4 is disposed on the inner side of the light guide 2 in plan view. Therefore, the occupied area of the key switch device can be reduced. Moreover, since the light guide 2 is directly biased by the elastic body 4, a reduction of height of the key switch device can be achieved.

In a key switch device according to the second aspect of the present disclosure, the upper end of the light guide 2 is disposed below the upper end of the base 1.

According to the key switch device of the second aspect, the light guide 2 can have a low height structure not protruding from the upper surface of the base 1. Moreover, the button 3 can have a simple structure with which consideration of interference with a light guide is not required.

In a key switch device according to the third aspect of the present disclosure, the light guide 2 includes a light guide main body 25 having a truncated cone shape, and the elastic body receiving portion 26 protruding in a radial direction thereof from the light guide main body 25.

In a key switch device according to the fourth aspect of the present disclosure, a recess 30 where the LED 25*b* is to be disposed is formed in a lower portion of the light guide 2.

According to the key switch device of the fourth aspect, the LED 25*b* is arranged into the light guide 2, and therefore a further reduction in height is realized.

In a key switch device according to the fifth aspect of the present disclosure, the key switch device further includes a slider 6, which is provided in the vicinity of the movable contact piece 42, including a pressing portion 59, the slider 6 being capable of moving in a down direction in response to pressing of the button 3 and being supported by the base 1 to be slidable in an up-and-down direction, wherein the movable contact piece 42 includes a press receiving portion 57 to be pressed by the pressing portion 59, and the slider 6 is configured to be biases by the press receiving portion 57 toward the down direction after the slider 6 moves toward the down direction and the pressing portion 59 passes over the press receiving portion 57, so that the slider 6 collides with the base 1 or a part of the button, generating a sound.

According to the key switch device of the fifth aspect, it is possible to cause the slider 6 to collide with the base 1 to generate a sound by pressing the button 3 in spite of the low height.

It is to be noted that suitable combinations of arbitrary embodiments or modifications of the above various embodiments or modifications can exhibit the respective effects thereof. Moreover, combinations of embodiments or combinations of examples, or combinations of embodiments and examples are possible, and combinations of features in different embodiments or examples are also possible.

While the present disclosure has been fully described in connection with the preferred embodiments with reference to the accompanying drawings, various changes or modifications will be apparent to those skilled in the art. Such variations or modifications are to be understood as included within the scope of the present disclosure as set forth in the appended claims, unless they depart therefrom.

INDUSTRIAL APPLICABILITY

A key switch device according to the present disclosure can be adopted for a keyboard or the like.

REFERENCE SIGNS LIST

1. base
2. light guide
3. button
4. coil spring (example of elastic body)
5. contact opening/closing mechanism
6. slider
7. elevation mechanism
8. bottom portion
9. rectangular frame portion
10. opening
11. lock receiving portion
12. first mount
13. second mount
14. first locking groove
15. first terminal hole
16. first locking ridge
17. second locking groove
18. second locking ridge
19. second terminal hole
20*a*, 20*b*. depression
21*a*, 21*b*. side wall
22. flange portion
23. extrusion prevention wall
24. recessed part
25. light guide main body
25*b*. LED
26. elastic body receiving portion
27. receiving portion main body
28. cylindrical body
29. claw portion
30. recess
31. flat plate portion
32. side wall portion
33*a*, 33*b*. extending portion
34. spring guide portion
35. guide wall
36. guide groove
37. inclined surface
38. bearing hole
39. projection
40. support portion
41. fixed contact piece
42. movable contact piece
43. first flat surface portion
44. fixed terminal portion
45. second flat surface portion
46. third flat surface portion
47. fixed contact
48. fourth flat surface portion
49. first locking protrusion
50. first locking recess
51. first flat surface portion

52. movable terminal portion
53. second flat surface portion
54. third flat surface portion
55. second locking protrusion
56. second locking recess
57. protruding piece
58. movable contact
59. pressing portion
60. first inclined surface
61. concave surface
62. second inclined surface
64. guided protrusion
65. flat portion
66. lifted protrusion
67. first arm
68. second arm
69. shaft
70. arm portion
71. first shaft portion
72. second shaft portion
73. first projection
74. bearing pore
75. second projection

The invention claimed is:

1. A key switch device comprising:

a base including an opening in a central part thereof;

a light guide including an elastic body receiving portion, the light guide being supported by the base to be disposed in the opening;

a button attached capable of approaching and separating from the base to cover the light guide;

an elastic body of which a lower end abuts on the elastic body receiving portion of the light guide, the elastic body being disposed between the elastic body receiving portion and a lower surface of the button, and the elastic body biasing the button in a separating direction where the button is separated from the base;

a fixed contact piece including a fixed contact, the fixed contact piece being attached to the base; and a movable contact piece, which is attached to the base, including a movable contact to be brought into contact with the fixed contact when the button is moved toward the base in an approaching direction where the button approaches the base.

2. The key switch device according to claim 1, wherein an upper end of the light guide is disposed below an upper end of the base.

3. The key switch device according to claim 2, wherein the light guide includes a light guide main body having a truncated cone shape, and the elastic body receiving portion protruding in a radial direction thereof from the light guide main body.

4. The key switch device according to claim 1, wherein a recess where a LED is to be disposed is formed in a lower portion of the light guide.

5. The key switch device according to claim 1, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

6. The key switch device according to claim 2, wherein a recess where a LED is to be disposed is formed in a lower portion of the light guide.

7. The key switch device according to claim 3, wherein a recess where a LED is to be disposed is formed in a lower portion of the light guide.

8. The key switch device according to claim 2, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

9. The key switch device according to claim 3, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

10. The key switch device according to claim 4, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

11. The key switch device according to claim 6, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

12. The key switch device according to claim 7, further comprising a slider, which is provided in vicinity of the movable contact piece, including a pressing portion, the slider moving in the approaching direction in response to pressing of the button and being supported by the base to be slidable in the separating direction and the approaching direction, wherein the movable contact piece includes a press receiving portion to be pressed by the pressing portion, and the slider is configured to be biased by the press receiving portion toward the approaching direction after the slider moves toward the approaching direction and the pressing portion passes over the press receiving portion, so that the slider collides with the base or a part of the button, generating a sound.

13. The key switch device according to claim 5, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

14. The key switch device according to claim 8, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

15. The key switch device according to claim 9, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

16. The key switch device according to claim 10, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

17. The key switch device according to claim 11, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

18. The key switch device according to claim 12, wherein the slider includes the pressing portion in a central part thereof and guided protrusions in both ends thereof, and the button includes guide grooves each of which accommodates each of the guided protrusions and guides movements of each of the guided protrusions in the separating direction and the approaching direction.

* * * * *